US005390109A

United States Patent [19]

Takemoto et al.

[11] Patent Number: 5,390,109

[45] Date of Patent: Feb. 14, 1995

[54] SENSOR FOR DETECTING LOCATION OF METAL BODY

[75] Inventors: Takatoshi Takemoto; Kazunari Kawashima, both of Tokyo; Shigeru Handa, Hachioji, all of Japan

[73] Assignee: Kabushiki Kaisha Ace Denken, Tokyo, Japan

[21] Appl. No.: 910,301

[22] PCT Filed: Nov. 25, 1991

[86] PCT No.: PCT/JP91/01611

§ 371 Date: Jul. 21, 1992

§ 102(e) Date: Jul. 21, 1992

[87] PCT Pub. No.: WO92/09344

PCT Pub. Date: Jun. 11, 1992

[30] Foreign Application Priority Data

Nov. 24, 1990 [JP] Japan ..... 2-320365

[51] Int. Cl.[6] ..... A63F 7/38

[52] U.S. Cl. ..... 364/410; 364/411; 324/207.11; 324/219; 273/239

[58] Field of Search ..... 273/236–239, 273/287; 364/410–411, 460, 516; 343/720, 729, 824, 897; 324/200, 207.17, 207.23, 207.24, 207.26, 207.11, 207.2, 207.22, 219; 342/368; 178/20

[56] References Cited

U.S. PATENT DOCUMENTS

| | | | |
|---|---|---|---|
| 4,325,551 | 4/1982 | Kulesza et al. | 273/110 |
| 4,658,373 | 4/1987 | Murakami et al. | 364/559 |
| 4,929,824 | 5/1990 | Miyazaki | 364/525 |
| 5,069,450 | 12/1991 | Pyle | 273/25 |
| 5,082,286 | 1/1992 | Ryan et al. | 273/238 |
| 5,216,605 | 6/1993 | Yardley et al. | 364/424.02 |

FOREIGN PATENT DOCUMENTS

| | | | |
|---|---|---|---|
| 51-19379 | 6/1976 | Japan . | |
| 52-15354 | 2/1977 | Japan . | |
| 60-20276 | 2/1985 | Japan . | |
| 60-114283 | 6/1985 | Japan . | |
| 60-188393 | 12/1985 | Japan . | |
| 61-179181 | 8/1986 | Japan . | |
| 63-210689 | 9/1988 | Japan . | |
| 64-3506 | 1/1989 | Japan . | |
| 1582409 | 1/1981 | United Kingdom | 324/207.20 |

*Primary Examiner*—Emanuel T. Voeltz
*Assistant Examiner*—Craig Miller
*Attorney, Agent, or Firm*—Lowe, Price, LeBlanc & Becker

[57] ABSTRACT

The present invention comprises a sensing matrix (20) comprised of matrix-arranged sensing units for sensing an object, a driving means (40, 50, 63) which drives the sensing matrix (20) and receives a signal showing a state of each sensing unit, and a detecting means (30) which detects location of the object on the sensing matrix (20) on the basis of the signal received by said driving means. The detecting means (30) includes an offset means (**30*a*) which sequentially updates and memorizes a value of the received signal as an offset value at every sensing unit, an operation means (30*b*) which operates a change in values between a value of a newly received signal and the offset value before updating, and a comparing means (30*c***) for comparing the change in values between the two with the set value which is set beforehand for detecting the presence of the object.

6 Claims, 16 Drawing Sheets

SENSOR FOR DETECTING LOCATION OF METAL BODY

TECHNICAL FIELD

The present invention relates to a sensor for detecting the location of a metal body. More particularly, it relates to a sensor which is suitable for detecting the location of a metal body within, for example, a space held between parallel planes.

BACKGROUND ART

Apparatuses which need to have a sensor for detecting the location of a metal body are, for example, metal detectors, game machines and so on. By way of example, some of the game machines are such that a metal body, e.g., a metal ball is moved within a specified space which has been set in the game machine, and that whether or not a prize is won is determined in accordance with the movement of the ball. A typical example of such a game machine is, for example, a "pachinko" (Japanese upright pinball) game machine with which a game player causes a metal "pachinko" ball to move down within a space held between parallel planes and provided with a large number of obstacles.

The "pachinko" game machine has a panel which defines the space for moving the "pachinko" ball, a glass plate which covers the panel at a fixed interval therefrom, and a projectile mechanism which functions to project the "pachinko" ball to the upper part of the panel. The "pachinko" game machine is so installed that the panel extends substantially in the vertical direction. The panel is formed with a plurality of safe holes each of which serves to make a hit when the "pachinko" ball has been led thereinto and driven out of the panel, and a single out hole into which the "pachinko" balls having failed to enter the safe holes are finally gathered to be driven out of the panel. Besides, a large number of pins (or nails) are planted as obstacles on the panel substantially perpendicularly thereto in the state in which they protrude from the panel to a distance corresponding to the diameter of each "pachinko" ball, in order that the "pachinko" ball falling along the panel may frequently collide against the pins to have its moving direction altered. The pins are arranged on the panel in a predetermined distribution in which, while altering the moving direction of the colliding "pachinko" ball, they lead this ball so as to proceed toward the safe hole in some cases and to miss the safe hole in other cases.

Owing to the construction as stated above, the "pachinko" game machines come to have individualities such as a machine in which it is easy to register hits and a machine in which it is difficult to register hits, depending upon the slight differences of the respective machines in the arrangement and inclinations of the pins. Even identical machines involve such differences as having safe holes with a high hit rate and safe holes with a low hit rate. Moreover, the differences are variously discrepant among the machines.

In a game center or the like wherein the game machines of this type are installed in large numbers, to know the individualities of the respective game machines is important for management in relation to the profit administration and customer administration of the game center. By way of example, when many of the machines register hits excessively, the game center side suffers a loss, whereas when all the machines are difficult to register hits on, customers become disinterested, which is unfavorable to business. Accordingly, countermeasures need to be taken by knowing the individualities of the respective game machines which are installed in the center.

For such a purpose, it is practised to detect the moving courses of the "pachinko" balls in the "pachinko" game machine. In the official gazette of Japanese Patent Application Publication No. 3506/1989, for example, there is disclosed as a sensor for such a purpose an apparatus equipped with an upper sheet and a lower sheet which have a pair of contacts. This technique senses the existence of the "pachinko" ball in such a way that the "pachinko" ball gets on the upper sheet and depresses it, whereby the pair of contacts come into touch.

With the prior-art sensor, however, since the sheets have the pairs of contacts, they are restricted in arrangement, and they can be arranged only along the passages of the "pachinko" balls. It is therefore impossible to detect the motions of the balls from the point of view at which the whole panel is seen. This results in the problem with this apparatus it is difficult to detect, for example, how the balls enter the safe holes and the out hole.

In addition, since the detection is based on the physical touch of the pair of contacts, it can take place in some moving states of the ball that the depression of the sheet becomes too weak to bring the pair of contacts into touch, so the motion of the ball is not detected. Besides, inferior touches can occur due to the wear, corrosion etc. of the pair of contacts. Further, the erroneous touch of the pair of contacts can be incurred by a vibration or the like or by chattering. For these reasons, the apparatus has the problem of lacking reliability.

Another problem is that, since a pressure applied by the ball is utilized, the motion of the ball is delicately affected contrariwise.

Such problems can be encountered, not only in the "pachinko" game machine, but also in different machines. It is accordingly desired to overcome these problems.

In addition, in the detection of a metal body in abovementioned game machines, sometimes it is required to detect metal bodies in the state of motion in distinction from others in the stationary state. For example, for detecting the movement course of the metal body, the processing of a signal for investigating a change of the location is needed at each detection of the location. However, with the prior-art detection apparatus, when a plurality of metal bodies exist, the processing of the signal for investigating the change of the location is needed for each of the metal body even when only some of them are moving. For this reason, there is a problem that tasks are imposed on the apparatus which processes the signal.

DISCLOSURE OF THE INVENTION

An object of the present invention is to provide a sensor for detecting the location of a metal body, according to which any location of the metal body within a specified space can be detected out of touch with the metal body and without employing contacts attended with a physical touch, whereby a detected result of high reliability is obtained.

Also, another object of the present invention is to provide a sensor for detecting the location of a metal body, according to which a moving metal body can be detected distinguishing from a stationary metal body.

In order to accomplish the object, according to one aspect of the present invention, there is provided a sensor for detecting the location of a metal body, characterized by comprising a sensing matrix including sensing units arranged in the form of a matrix for sensing an object, a driving means for driving the sensing matrix to receive a signal indicative of the state of each of the sensing units, and a detecting means for detecting the location of the object on the sensing matrix on the basis of the signals received by above-mentioned driving means including an offset means which sequentially updates and memorizes the value of above-mentioned received signal as an offset Value at each sensing unit; an operation means which operates a change in values between a value of a newly received signal and the offset value before updating, and a comparing means for comparing the change in values between the two with a preset value to detect the presence of the object.

As the above-mentioned operation means, there may be mentioned an operation means which obtains an absolute value of a difference between a value of a newly received signal and the offset value before updating as the change in values between the two.

As the above-mentioned comparing means, there may be mentioned a comparing means which compares the obtained absolute value of the difference with the preset value to detect the presence of the object when the absolute value which exceeds the preset value.

The above-mentioned detecting means may include a function to obtain an average value of a signal which indicates a state of each sensing unit without an object and set the average value as an initial offset value for the offset means at the time of the initialization.

The above-mentioned sensing matrix has a plurality of signal sending lines which have a folded-back shape including outward paths and return paths arranged coplanarly to generate a magnetic field when energized, and a plurality of signal receiving lines which have a folded-back shape including outward paths and return paths arranged coplanarly so as to be electromagnetically coupled with the above-mentioned signal sending lines to detect a change of a magnetic flux caused by the approach of the metal object, the above-mentioned signal sending line and the above-mentioned signal receiving line are arranged with their planes in parallel and in directions intersecting each other. The above-mentioned sensing unit is set up within a place defined by the outward path and return path of the signal sending line and the outward path and return path of the signal receiving line intersecting with those of the signal sending line.

The above-mentioned driving means may employ a signal sending circuit which sends alternating current signals sequentially to the individual signal sending lines; and a signal receiving circuit which receives the signals from the individual signal sending lines sequentially in synchronism with the signal sending circuit.

A sensing matrix constructed by arranging sensing units for detecting objects in the form of a matrix may well be arranged, for example, so as to cover the domain where metal bodies should be detected. In this state, with driving the sensing matrix, the signals showing the state of the individual sensing units are received by the driving means. If there is any metal body within the domain to be detected, the detecting means detects the location of the object on the sensing matrix based on the signal received by above-mentioned driving means.

In this case, the value of the signals from the receiving circuit are updated as the offset value at each sensing unit with the offset means and memorized sequentially, and the difference between the value of the signal from the receiving circuit and the offset value before updating is obtained as the absolute value. The absolute value is compared to the offset value by the comparing means, then the detection of a metal body at a sensing unit is made according to the result as to whether the absolute value is as same as or larger than the offset value or not. Therefore, only the moving metal bodies can be detected. Also, since the absolute value of the difference between the value of a signal from the receiving circuit and the offset value before updating is compared to the offset value with the comparing means, it is less susceptible to the temperature drift in comparison with the detection in which the measured value itself is employed.

BEST MODE FOR CARRYING OUT THE INVENTION

Now, the embodiment of the present invention will be described with reference to the drawings.

Figure 1:
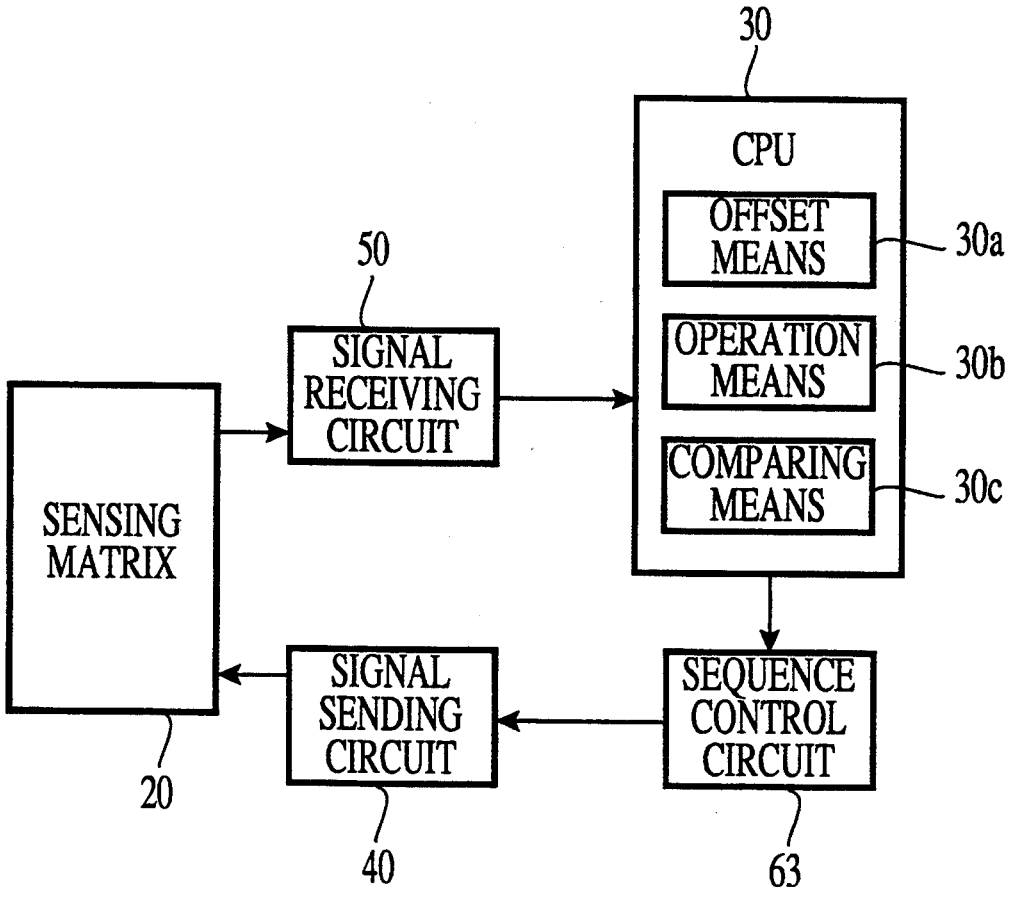
FIG. 1 is a block diagram showing the schematic configuration of a sensor for detecting the location of a metal body in the embodiment of the present invention.

As shown in FIG. 1, the sensor of this embodiment includes a sensing matrix 20, the sensing units for detecting a metal body as a detection object are arranged in the form of the matrix; a signal sending circuit 40, a signal receiving circuit 50, and a sequence control circuit 63 compose a driving means which receives the signals showing the state of the individual sensing units by driving the matrix 20; and a control unit 30 which has a function as a means for detecting the location of a metal body by the sending signal and the received signal.

The control unit 30 has an offset means 30*a* which updates and memorizes the value of received signals sequentially as offset values for each sensing unit, an operation means 30*b* which obtains a change or difference in the values between the newly received signal and the offset value before updating, and a comparing means 30*c* which compares the change or difference therebetween with a preliminarily set value to detect the presence of the object.

Next, the details of each part of this embodiment will be described with reference to an application in which the sensor of this embodiment is used for a game machine.

Figure 2:
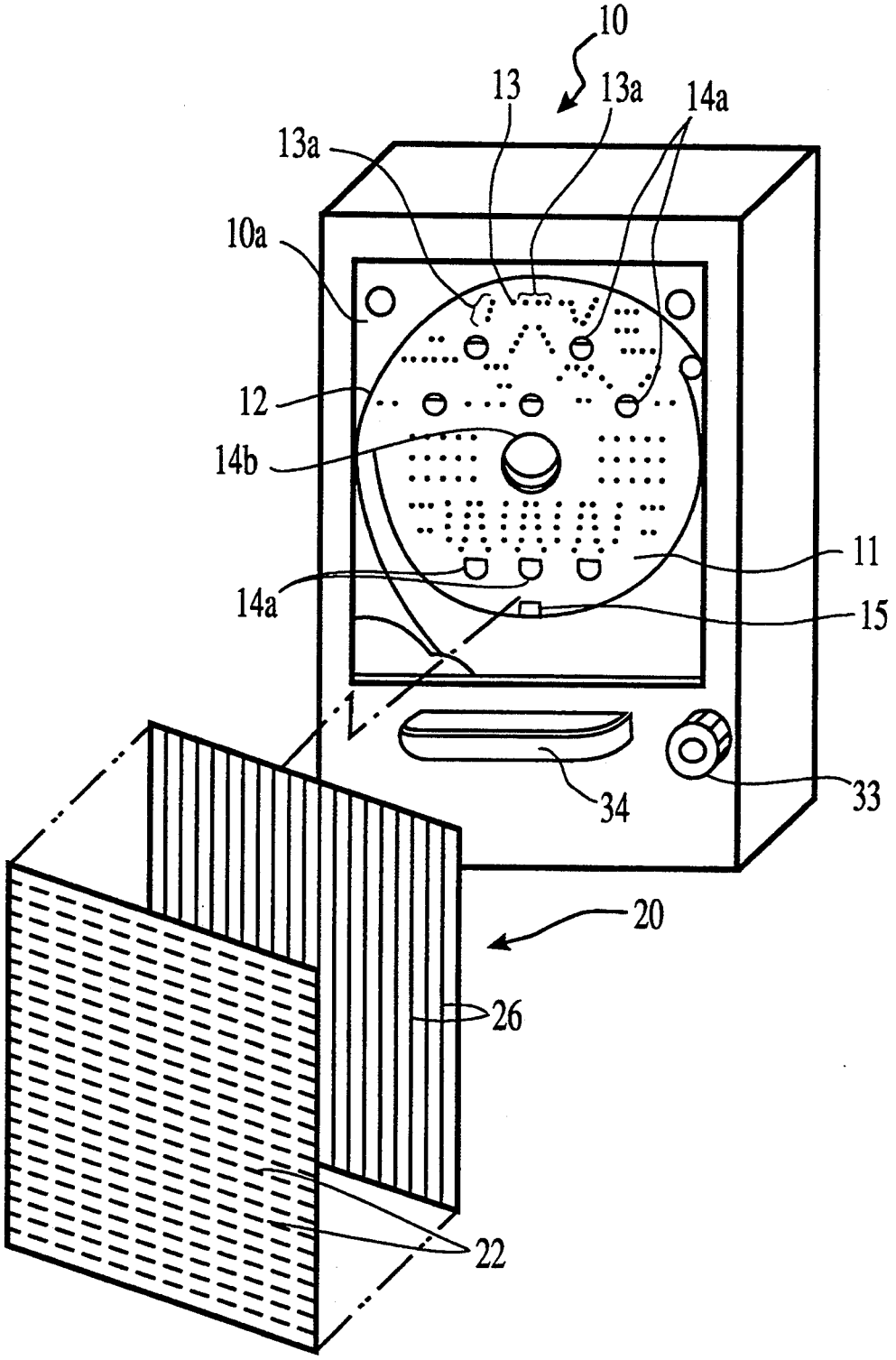
FIG. 2 is a conceptually exploded isometric view showing a game machine and the sensing matrix, in which the present invention is applied to the game machine.
Figure 3:
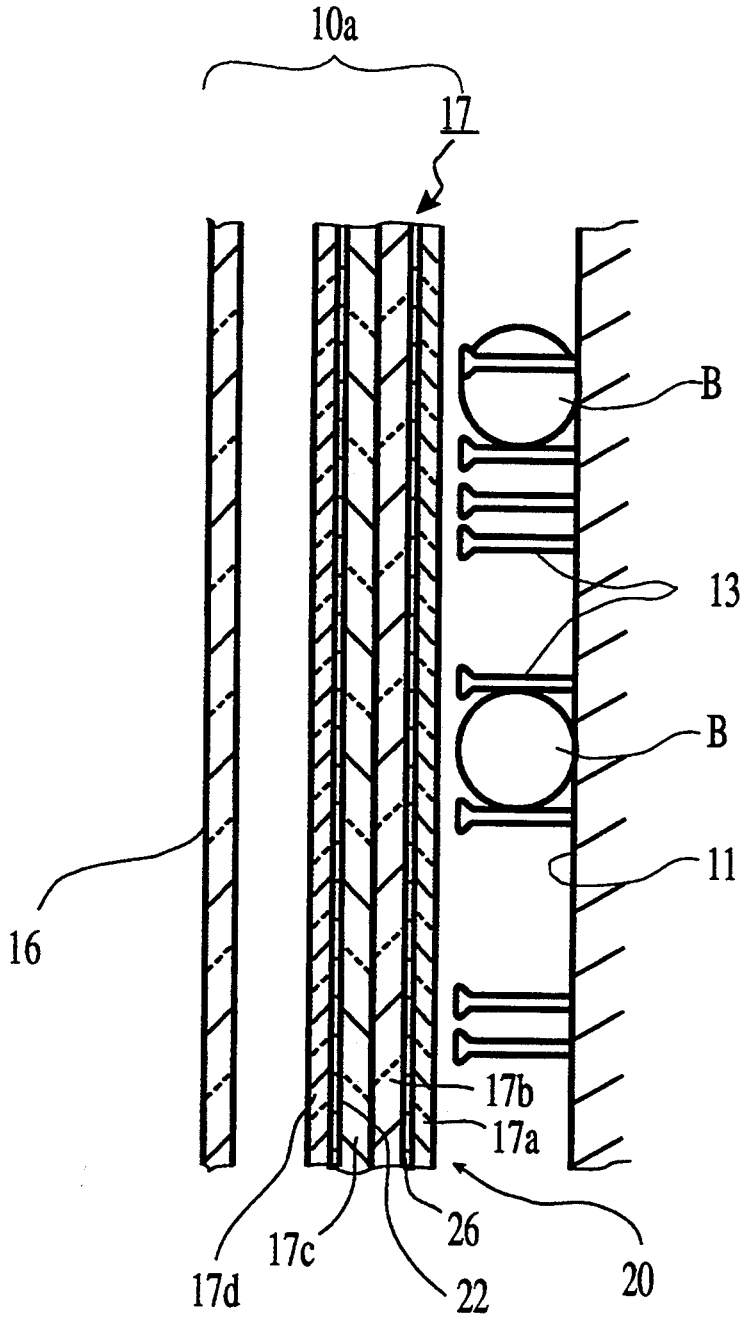
FIG. 3 is a vertical sectional view of a part of the game machine.

As shown in FIGS. 2 and 3, a game machine 10 to which is applied this embodiment includes a panel 11 which defines a space for moving a metal ball B, a glass cover 10*a* which covers the panel 11 with a fixed interval held therebetween, and a projectile mechanism which serves to project the metal ball B toward the upper part of the panel 11. This game machine 10 is so installed that the panel 11 extends substantially in the vertical direction.

A guide rail 12 for defining a game region is mounted on the panel 11 of the game machine 10. A domain inside the guide rail 12 is the game region. A large number of pins (or nails) 13, 13, . . . for repelling the metal ball B are planted and erected on the part of the panel 11 within the game region. In addition, a plurality of 'safe' holes 14*a*, 14*a*, . . . are provided in various places, and a single 'out' hole 15 is provided at the lower end of the game region.

As depicted in FIG. 3, the pins 13 are erected to be substantially perpendicular in the state in which each pin protrudes from the panel 11 by a length corresponding to the diameter of the metal ball B. Besides, the pins 13 are arranged so that the metal ball which falls along the panel 11 while passing between the pins 13, 13 may frequently collide against the large number of pins 13 existent in its traveling course, thereby having its direction of movement changed. More specifically, as depicted in FIG. 2, at least two of the pins 13 gather to form a pin line or pin group 13*a*. Such pin lines or pin groups 13*a* have their distribution determined in such a manner that, while having its direction of movement altered, the colliding metal body may be led so as to proceed toward the safe hole 14*a* in some cases or to miss the safe hole 14*a* in other cases, depending upon the projected position of the metal body, namely, the fall starting point thereof, the moving direction and speed thereof on that occasion, and so on.

The safe hole 14*a* is a hole which serves to make a hit when the metal body enters it and is driven out of the panel 11. On the other hand, the out hole 15 is a hole into which the metal bodies having failed to enter any of the safe holes 14*a* are finally collected to be driven out of the panel 11.

As shown in FIG. 3, the front glass cover 10*a* covering the panel 11 has a double structure composed of a front glass element 16 and an inner glass element 17.

The projectile mechanism includes a striking handle 33, and a drive mechanism not shown. The handle 33 is mounted at the front of the game machine 10, and is used for the operation of striking or knocking the metal body. The striking operation is effected by rotating the handle 33 at a desired angle.

Also, a tray 34 for receiving the metal bodies delivered by the game machine 10 is mounted at the front of this game machine. A predetermined number of metal bodies are awarded as a prize when the metal body projected to the panel 11 has entered any of the safe holes 14*a*.

Figure 4:
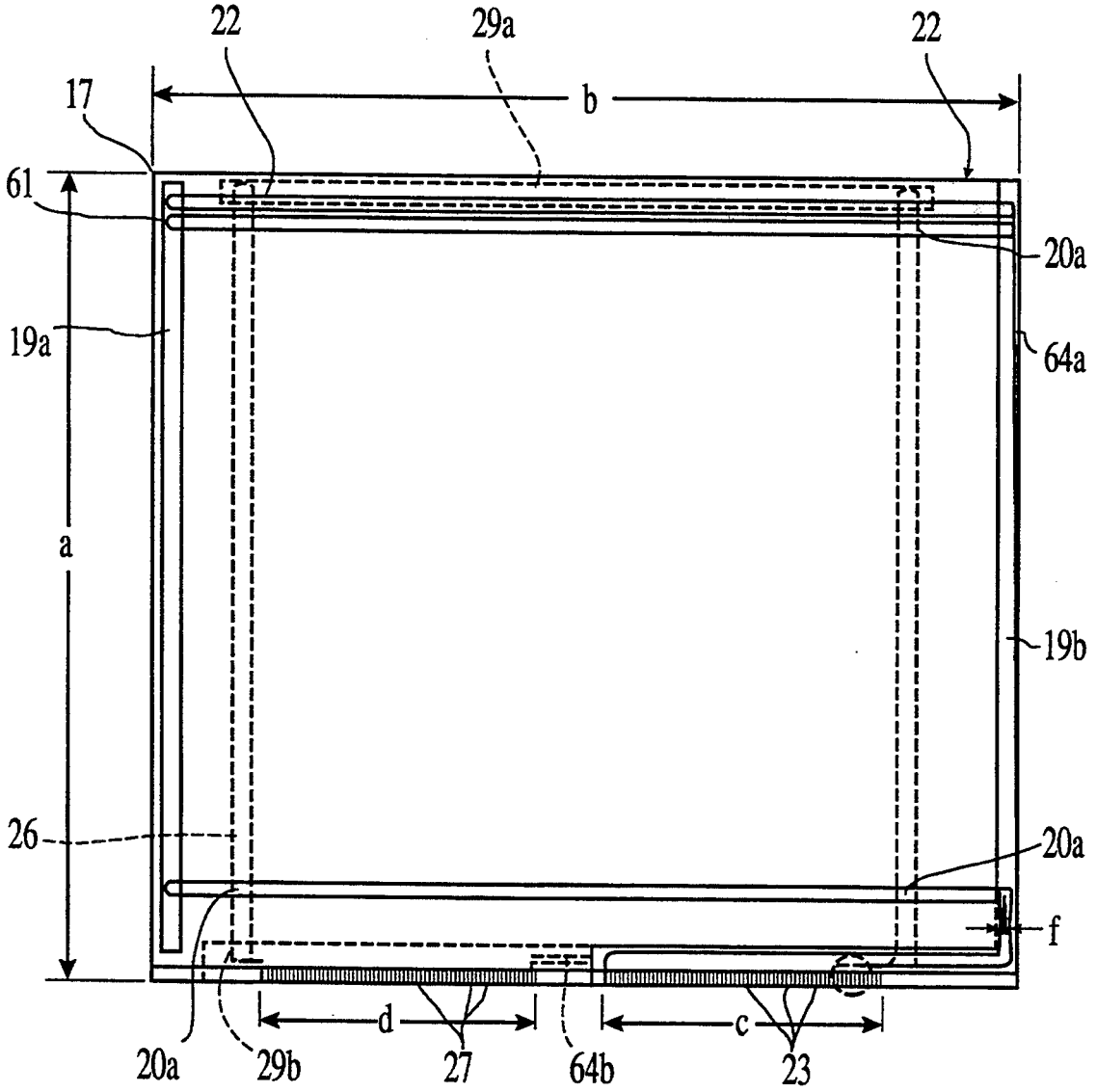
FIG. 4 is a front view of the sensing matrix.

As shown in FIG. 3, a sensing matrix 20 is constructed by using an inner glass element 17 extending along the panel 11 at a fixed interval therefrom as a base plate. As shown in FIG. 4, the sensing matrix 20 has a plurality of signal sending lines 22 and a plurality of signal receiving lines 26. A plurality of single signal sending lines 22 are arranged on one side of the inner glass element 17 while extending in parallel unidirectionally. And a plurality of signal receiving lines 26 are arranged on the opposite side of the inner glass element 17 while extending in parallel unidirectionally. Each signal sending line 22 is U-turned at a turning portion 61 into a folded-back shape (or a loop shape) having a paralleled portion. Likewise, a single signal receiving line 26 is U-turned into a folded-back shape (or a loop shape) having a paralleled portion. Signal sending terminals 23 and signal receiving terminals 27 are concentratedly arranged at a lower end in relation to an inner glass element 17 which is attached to the game machine.

Each signal receiving line 26 is arranged at a position permitting it to be electromagnetically coupled with the signal sending line, and has its plane held in parallel with the plane of each signal sending line 22 and is extended in the direction intersecting orthogonally to the extending direction of the line 22 in order that its electromagnetic characteristics may be changed by the approach of a metal body, and the signal sending lines 22 and the signal receiving lines 26 constitute a sensing matrix 20 in a plane shape.

In the front view of FIG. 4, individual square parts enclosed with the intersecting signal sending lines 22 and signal receiving lines 26 form sensing units 20*a*, 20*a*, . . . each of which senses the metal body.

Figure 5A:
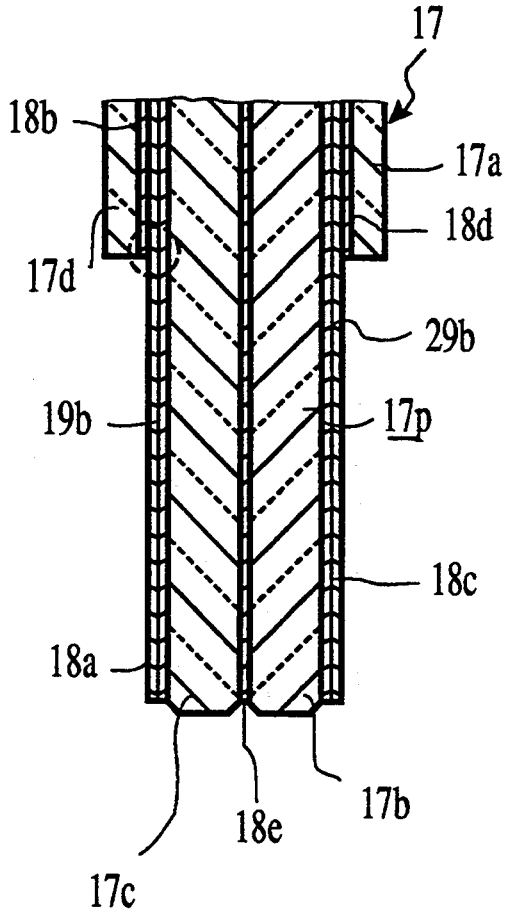
FIG. 5A is an enlarged sectional view of an inner glass element which includes a sensing matrix.
Figure 5B:
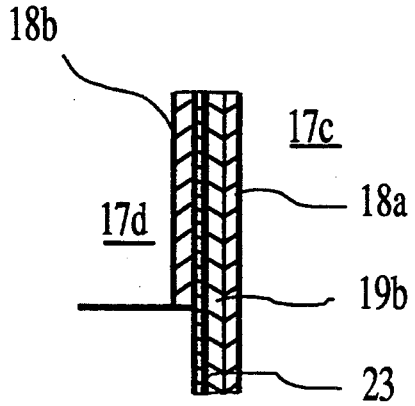
FIG. 5B is an enlarged sectional view of the part of FIG. 5A circled by a broken line.

FIG. 5A shows an enlarged sectional view of the inner glass element 17, and FIG. 5B shows an enlarged view of a circular part enclosed with a broken line in FIG. 5A.

The inner glass element 17 is constructed by stacking four layers; an inner protective glass plate 17*a* which is a protective sheet for the signal receiving lines 26 (shown in FIG. 4), a glass base plate 17*b* on a signal receiving side, a glass base plate 17*c* on a signal sending side, and an outer glass plate 17*d* which is a protective sheet for the signal sending lines 22 (shown in FIG. 4). The inner glass element (front glass) 17 is a glass base plate in a square shape that its three representative dimensions are; the length a is 367 [mm]±10 [mm], the width b is 405 [mm]±10 [mm], and the thickness is 3.0 ~3.5 [mm]. The inner protective glass plate 17*a* and the outer protective glass plate 17*d* are shorter than a signal-receiving-side glass base plate 17*b* and a signal-sending-side glass base plate 17*c* at their length, and the lower end 17*p* of the inner glass element 17 is exposed.

The plurality of signal receiving lines 26 which have a folded-back shape and juxtaposed each other are borne between the inner protective glass plate 17*a* and the signal-receiving-side glass base plate 17*b*, and the plurality of signal sending lines 22 which have a folded-back shape and juxtaposed each other are borne between the signal-sending-side glass base plate 17*c* and the outer protective glass plate 17*d*. Therefore, the inner glass element 17 is so fabricated that the signal sending lines 22 are borne on a side of a signal-sending-side glass base plate 17*c*, with layers of a transparent adhesive 18*a*; on the surface thereof bearing the outer protective glass plate 17*d*, with layers of a transparent adhesive 18*b*; the signal receiving lines 26 are borne on the other side of the glass base plate 17*b* with layers of a transparent adhesive 18*c*; on the surface thereof bearing the inner protective glass plate 17*a*, with layers of a transparent adhesive 18*d*; and on the other side of a signal-sending-side glass base plate 17*c* and the other side of a signal-receiving-side glass base plate 17*b* are bonded each other, with layers of a transparent adhesive 18*e*.

The whole front surface of the outer glass plate 17*d* lying in front of the plurality of signal sending lines 22 is formed with a shielding transparent conductor film. The transparent conductor film is made of, for example, an indium-tin oxide (I. T. O.) film or a tin oxide film.

Figure 6:
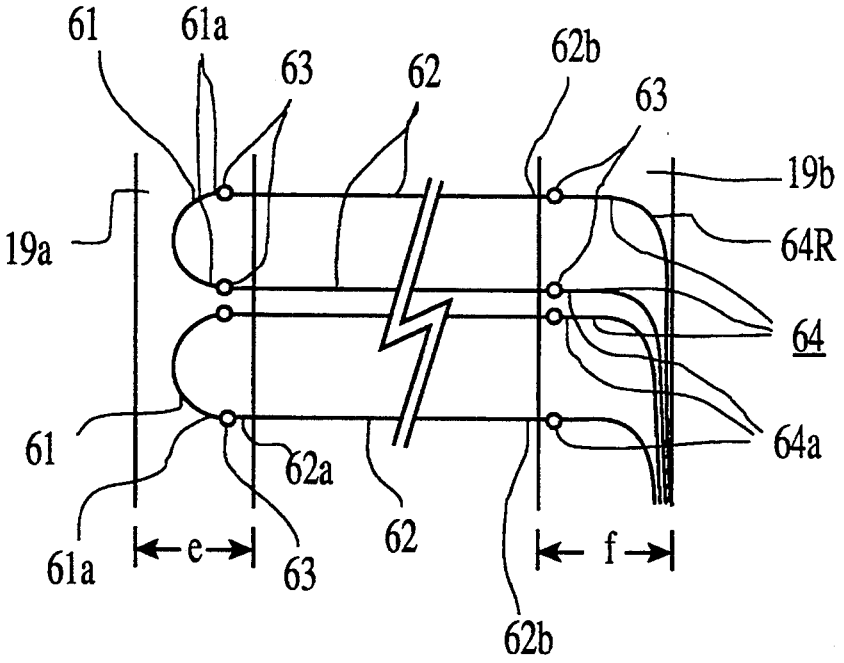
FIG. 6 is a front view of the signal sending lines in detail.
Figure 7:
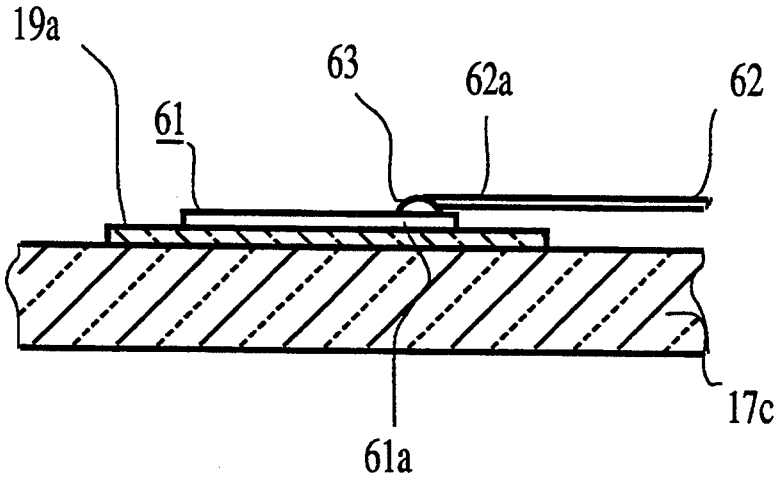
FIG. 7 is an enlarged sectional view of the signal sending line showing the connected state of wire.

As illustrated in FIG. 4, the signal-sending-side glass base plate 17 in a square shape has a signal-sending-side turning circuit board 19*a* bonded thereto along one vertical latus thereof, the circuit board 19*a* being formed of an elongate flexible printed-wiring circuit board (FPC), and it also has a signal-sending-side circumventing circuit board of an L shape 19*b* bonded thereto along the opposite vertical latus thereof and part of the bottom latus thereof, the circuit board 19*b* being similarly formed of a flexible printed-wiring circuit board. The signal-sending-side turning circuit board 19*a* is such that, as shown in FIG. 6, a plurality of arcuate turning portions 61, specifically, 32 of them, are formed in a row by a conductor pattern made of copper foil, and that, as shown in FIG. 7, one end 62*a* of each piece of wire 62 is connected to one end 61*a* of the corresponding turning portion 61 by welding or soldering with solder 63.

Figure 8:
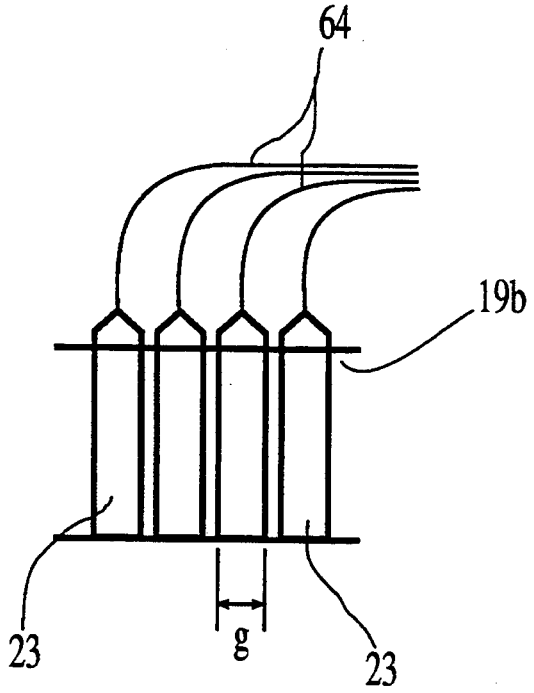
FIG. 8 is an enlarged front view of signal sending terminals.

FIG. 8 shows an enlarged view of a circular part enclosed with a broken line in FIG. 4. As shown in FIG. 8, the plurality of signal sending terminals 23, specifically, 64 of them, which extend vertically for external connections are formed of a conductor pattern made of copper foil, on the lower-end edge of the signal-sending-side circumventing circuit board 19*b* opposite the turning circuit board and along part of the lower-end latus.

As shown in FIG. 5A and 5B, the signal sending terminals 23 are arranged at the lower end 17*p* of the inner glass element 17 and are exposed due to the fact that they are not concealed by the outer glass plate 17*d*. That is, the outer glass plate 17*d* is bonded on the surface part of the signal-sending-side glass base plate 17*c* bearing the signal sending lines 22 (shown in FIG. 4), except the part thereof bearing the signal sending terminals 23. On the terminal side of each of the signal sending lines 22, there are the signal sending terminal 23 of the corresponding signal sending line 22 and a circumventive portion 64 for this signal sending terminal 23. The circumventive portions 64 for the signal sending terminals 23 are formed of a conductor pattern on the signal-sending-side circumventing circuit board 19*b*, and are laid along this signal-sending-side circumventing circuit board 19*b* from the corresponding signal sending terminals 23.

While being tensed, the wire piece 62 extending from the end 61*a* of each of the turning portions 61 has its other end 62*b* connected to the start point 64*a* of the corresponding circumventive portion 64 on the terminal side by welding or soldering with solder 63, whereupon the end 62*b* is connected to the signal sending terminal 23 through the circumventive portion 64. Incidentally, regarding the circumventive portions 64, two straight parts are connected using round parts 64R in order to eliminate any high-frequency problems.

Similarly, the signal-receiving-side glass base plate 17*a* in a square shape has a signal-receiving-side turning circuit board 29*a* bonded thereto along one lateral top latus thereof, and it also has an elongate signal-receiving-side circumventing circuit board 29*b* bonded thereto along part of the lateral bottom latus thereof. Likewise to the signal-sending-side turning circuit board 19*a*, the signal-receiving-side turning circuit board 29*a* is such that a plurality of arcuate turning portions 61, specifically, 32 of them, are formed of a conductor pattern made of copper foil, and that one end 62*a* of each piece of wire 62 is connected to one end 61*a* of the corresponding turning portion by welding or soldering with solder 63.

The plurality of signal receiving terminals 27, specifically, 64 of them, which extend vertically for external connections are formed of a conductor pattern made of copper foil, on the lower-end edge of the signal-receiving-side circumventing circuit board 29*b* opposite the turning circuit board and along part of the lower-end latus, and these signal receiving terminals are located at non-confronting positions at which they do not overlap each other when the signal-receiving-side glass base plate 17*b* is bonded to the signal-sending-side glass base plate 17*c*.

As shown in FIG. 5, the signal receiving terminals 27 are arranged at the lower end 17*p* of the inner glass element 17 and are exposed due to the fact that they are not concealed by the inner protective glass plate 17*a*. That is, the inner protective glass plate 17*a* is bonded on the surface part of the signal-receiving-side glass base plate 17*b* bearing the signal receiving lines 26, except the part thereof bearing the signal receiving terminals 27. On the terminal side of each of the signal receiving lines 26, there are the signal receiving terminal 27 of the corresponding signal receiving line 26 and a circumventive portion 64 for this signal receiving terminal 27. The circumventive portions 64 for leading the signal receiving lines to the signal receiving terminals 27 are formed of a conductor pattern on the signal-receiving-side circumventing circuit board 29*b*, and are laid along this signal-receiving-side circumventing circuit board 29*b* from the corresponding signal receiving terminals 27.

While being tensed, the wire piece 62 extending from the end 61*a* of each of the turning portions 61 has its other end 62*b* connected to the start point 64*a* of the corresponding circumventive portion 64 on the terminal side by welding or soldering with solder 63, whereupon the end 62*b* is connected to the signal receiving terminal 627 through the circumventive portion 64.

In this manner, each of the signal sending lines 22 or the signal receiving lines 26 is made up of the turning portion 61 which is formed on the corresponding turning circuit board 19*a* or 29*a*, the circumventive portions 64 which are formed on the corresponding circumventing circuit board 19*b* or 29*b*, the wire pieces 62, and the signal sending terminal 23 which forms the end part of the signal sending line 22 or the signal receiving terminal 27 which forms the end part of the signal receiving line 26. Incidentally, the surface of each wire piece 62 has a delustered black color and prevents the reflection of light in order to be inoffensive to the game player's eye.

The pattern of the sensing matrix 20 suitable for the ordinary game machine 10 is one which has the signal sending lines 22 in 32 rows and the signal receiving lines 26 in 32 columns, so that there are a total of 1024 sensing units 20*a*. Incidentally, in FIG. 4, the pattern except the outer part thereof is omitted from illustration.

The diameter of the wire of which each of the signal sending lines 22 and signal receiving lines 26 is formed is preferably set at a value of 25 mm~30 mm. In the case of this embodiment, the entire widths c and d of the signal sending terminals 23 and signal receiving terminals 27 as indicated in FIG. 4 are respectively set at 126 mm, and the widths e and f of the vertically-extending parts of the signal-sending-side turning circuit board 19*a* and signal-sending-side circumventing circuit board 19*b* as indicated in FIG. 6 are respectively set at 10 mm or less.

Besides, the width g of each of the signal sending terminals 23 and signal receiving terminals 27 as indicated in FIG. 8 is 1.5 mm. Owing to the fact that the widths e and f of the circumventive portions 64 are set at 10 mm or less, the signal-sending-side turning circuit board 19*a* and the signal-sending-side circumventing circuit board 19*b* are hidden by a mounting frame 1 for the inner glass element (front glass) 17 of the game machine and cannot be seen from the front side where the game player stands.

Figure 9:
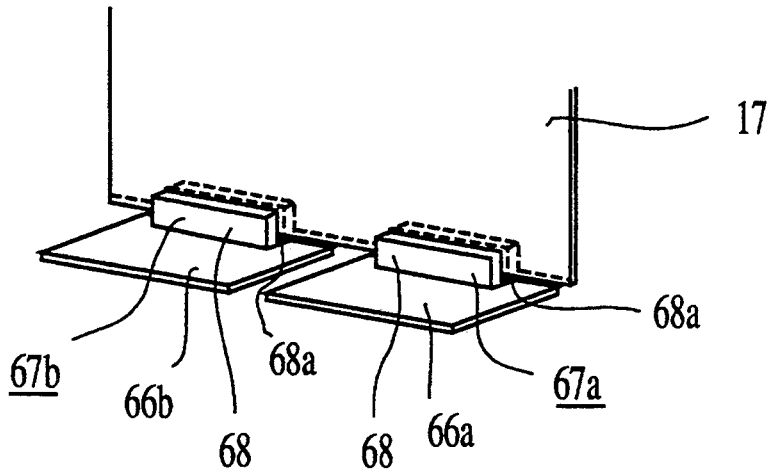
FIG. 9 is an isometric view showing the state in which the inner glass element is connected to a signal sending connector and a signal receiving connector.

As shown in FIG. 9, a signal sending circuit board 66*a* and a signal receiving-circuit board 66*b* are installed at the inner lower part of the mounting frame 1. The signal sending circuit board 66*a* is provided with a signal sending circuit 40 for sending signals to the plurality of signal sending lines 22 of the sensing matrix 20, while the signal-receiving circuit board 66*b* is provided with a signal receiving circuit 50 for received signals from the plurality of signal receiving lines 26. A signal sending connector 67*a* and a signal receiving connector 67*b* are respectively mounted on those positions of the circuit boards 66*a* and 66*b* which correspond to the signal sending terminals 23 and the signal receiving terminals 27.

The signal sending connector 67*a* is an edge connector for detachably connecting the signal sending terminals 23 to the signal sending circuit 40 on the signal sending circuit board 66*a*, while the signal receiving connector 67*b* is an edge connector for detachably connecting the signal receiving terminals 27 to the signal receiving circuit 50 on the signal receiving circuit board 66*b*. More specifically, the signal sending connector 67*a* or signal receiving connector 67*b* is so constructed that the upper part of an elongate insulator member 68 extending along the signal sending circuit board 66*a* or signal receiving circuit board 66*b* is formed with a slit 68*a* in the lengthwise direction of the insulator member, and that a large number of electrically-conductive wire pieces isolated by rubber for avoiding touching each other and connecting to the corresponding circuit board 66*a* or 66*b* are packed in the bottom of the slit 68*a* in a direction perpendicular to the circuit board 66*a* or 66*b*.

The inner glass element (front glass) 17 in which the signal sending terminals 23 and the signal receiving terminals 27 are arranged, can be inserted into the slits 68*a* of the insulator members 68. The signal sending connector 67*a* is connected with the signal sending terminals 23 of the signal sending lines 22 in the state in which the inner glass element 17 is held between both the inner surfaces of this connector, while the signal receiving connector 67*b* is connected with the signal receiving terminals 27 of the signal receiving lines 626 in the same manner.

The signal sending terminals 23 and signal receiving terminals 27 are respectively connected with the signal sending circuit 40 and signal receiving circuit 50 as follows: The signal sending terminals 23 and signal receiving terminals 27 are positioned under the inner glass element 17 and are inserted into the corresponding slits 68*a* so as to be able to connect with the signal sending connector 67*a* and signal receiving connector 67*b*, and the resulting inner glass element 17 is fitted in the mounting frame 1 so that the signal sending terminals 23 and signal receiving terminals 27 may be reliably connected with the signal sending connector 67*a* and signal receiving connector 67*b* by the weight of the element 17, which is about 1.2 [kg].

A signal processing system which constitutes the sensor of this embodiment is as shown in FIGS. 10~14.

Figure 10:
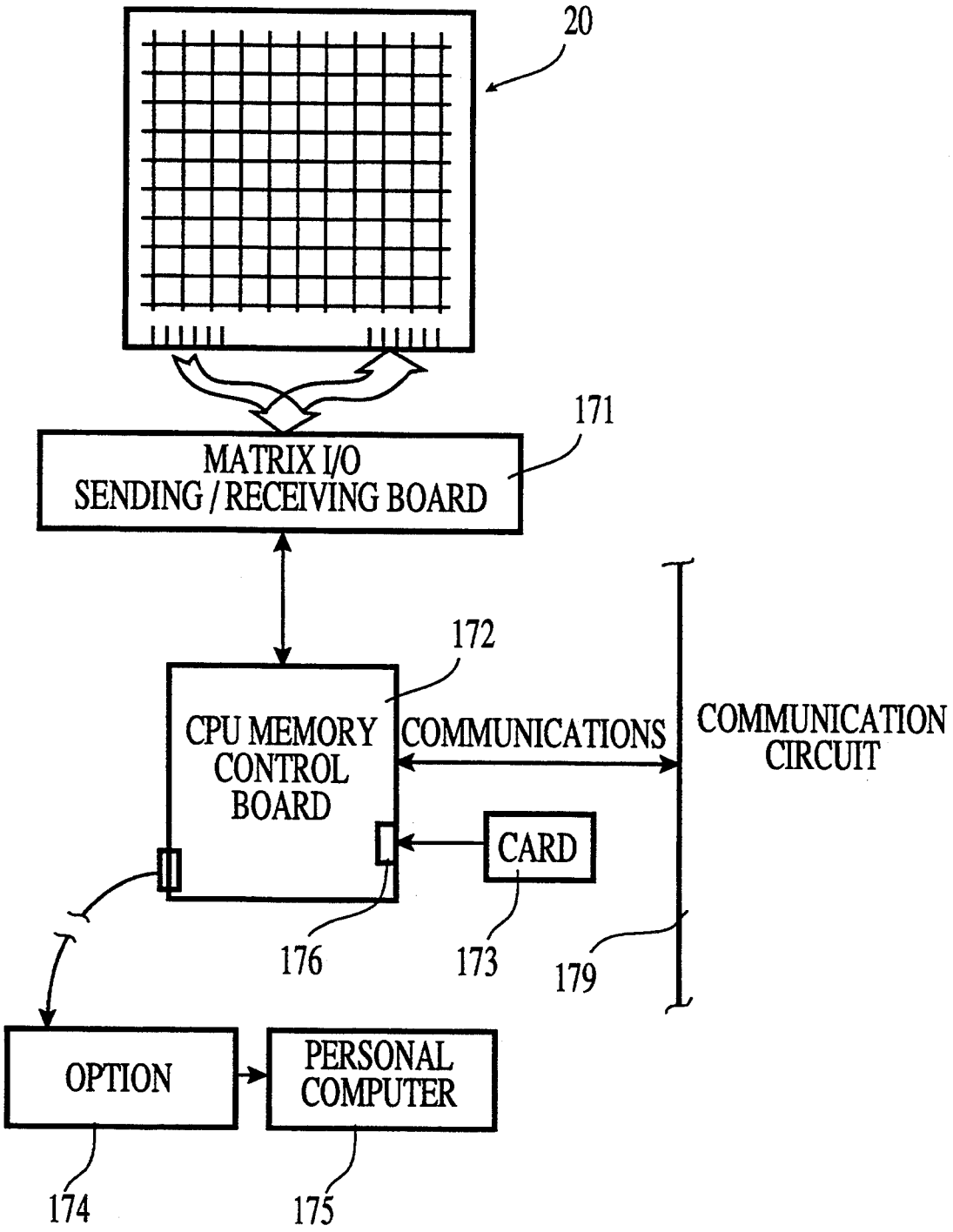
FIG. 10 is a block diagram showing an example of a configuration of a hardware for use in the embodiment of a sensor for detecting the location of a metal body of the present invention.

As illustrated in FIG. 10, the sensing matrix 20 is under the control of a CPU memory control board 172 through a matrix I/O sending/receiving board 171. The CPU memory control board 172 constitutes a data processor and is capable of communication by means of a communication circuit 179. Besides, the CPU memory control board 172 has an interface portion 176 which enables a control unit 30 to read the monitor points from a RAM card 173.

The RAM card 173 is a memory card for a monitor memory which stores therein data indicative of the monitor points for the metal body to allow the data to be read therefrom and is detachably set in the interface portion 176. The RAM card 173 stores therein data, as monitor data indicative of the positions of safe holes 14*a*, 14*a*, . . . formed on the panel of the game machine 10, a metal body detection position, and the position of an out hole 15, and an algorithm for detecting the metal body entering any of the safe holes 14*a*, 14*a*, . . . and out hole 15.

An option 174 connected to the CPU memory control board 172 is an apparatus for recording the movement courses of the metal bodies between the inner glass element 617 and the panel 11 of the game machine 10. The option 174 may be a storage apparatus employing a disk-type recording medium such as an optical disk, an optical-magnetic disk, etc. or a storage apparatus employing a tape-type recording medium such as an analog or digital recording tape recorder, a video tape recorder, etc. In addition, another computer system may also be employed. Further, a storage apparatus employing a solid recording medium such as a semiconductor memory can also be emploied. In addition, when the option of this embodiment is applied to a game machine, it is preferable to employ small one with a large capacity. It is because in a time zone in which the number of the game players increases, the activity rate of each game machine 10 heightens, and hence, an enormous storage capacity is required.

The recorded data in the option is processed and operated by a computer incorporated with a software for analysis of the data for the moving courses of the metal bodies, to obtain the data needed in a game center.

The matrix I/O sending/receiving board 171 includes the signal sending circuit board 66*a* provided with the signal sending circuit 40, and the signal receiving circuit board 66*b* provided with the signal receiving circuit 50. The signal sending circuit 40 is a circuit which sends signals of predetermined frequency to the individual signal sending lines 22 sequentially, while the signal receiving circuit 50 is a circuit which receives signals from the individual signal receiving lines 26 sequentially in synchronism with the signal sending circuit 40. Suitable as a voltage waveform to be applied to the signal sending lines 22 by the signal sending circuit 40 is a continuous sinusoidal wave which has a frequency of 1~1.3 [MHz] and which centers at 0 [V].

Figure 11:
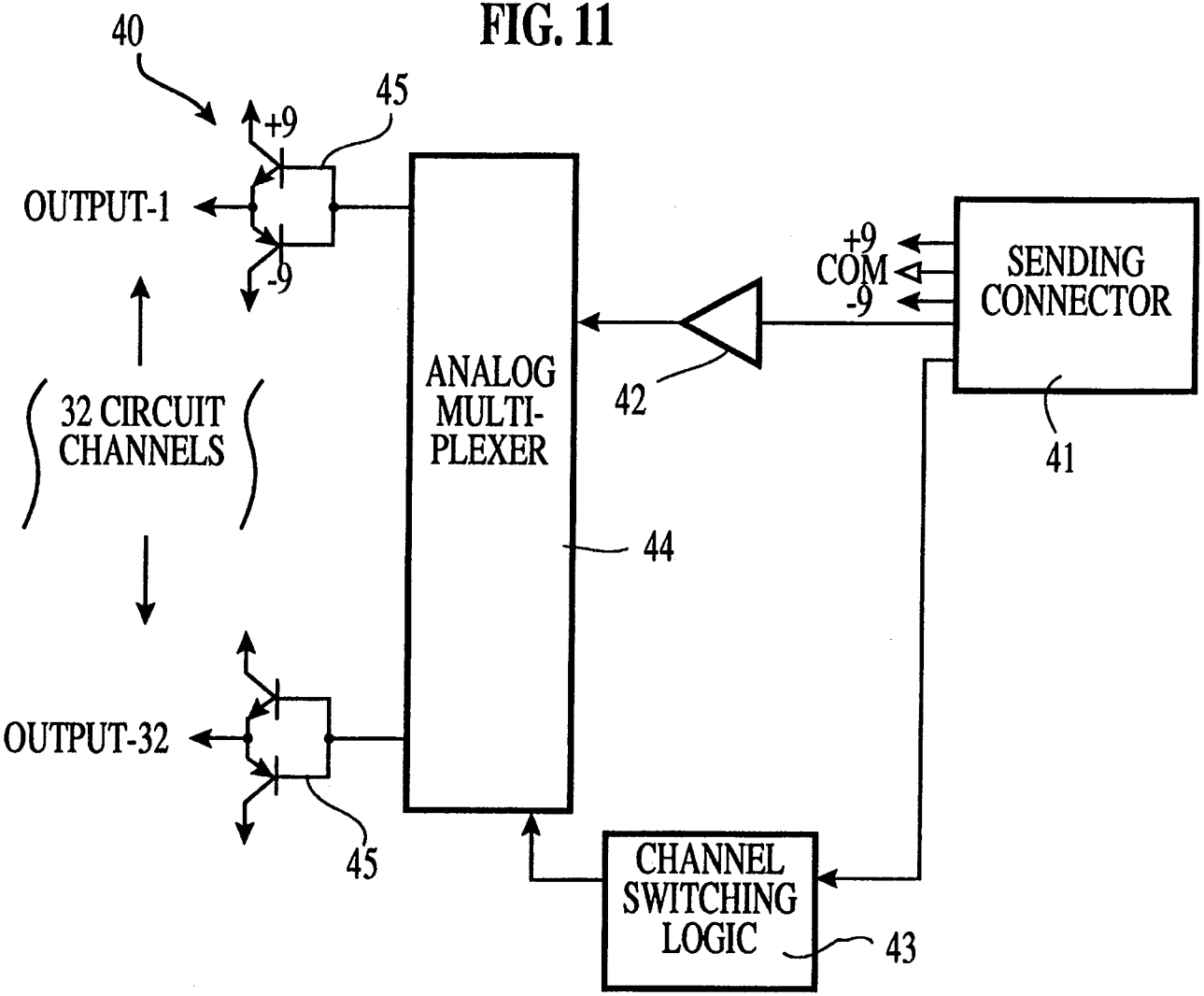
FIG. 11 is a block diagram of a signal sending circuit in a matrix I/O sending/receiving board included in above-mentioned hardware.

As shown in FIG. 11, the signal sending circuit 40 is configured of a signal sending connector 41, an amplifier 42 and channel switching logic 43 which are connected to the signal sending connector 41, an analog multiplexer 44 which is connected to both the amplifier 42 and the channel switching logic 43, and 32 totem-pole drivers of PNP and NPN transistors 45 which are all connected to the analog multiplexer 44 and which are respectively connected through the sides of the signal sending connector 67*a* to the signal sending lines 22 in the plural circuit channels, specifically, 32 circuit channels.

Figure 12:
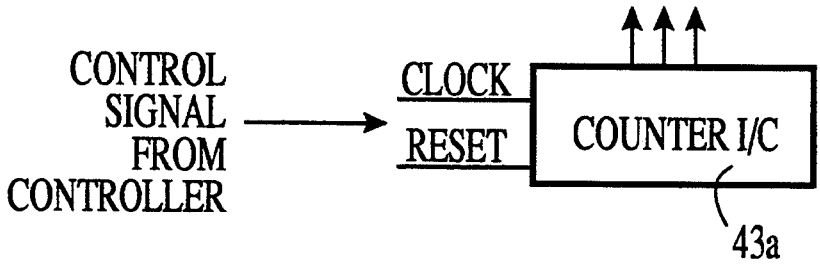
FIG. 12 is a block diagram showing the principal part of a channel switching logic included in above-mentioned hardware.

As shown in FIG. 12, the channel switching logic 43 is operated with two, clocking and resetting control signals by effectively utilizing a counter IC 43*a*.

Figure 13:
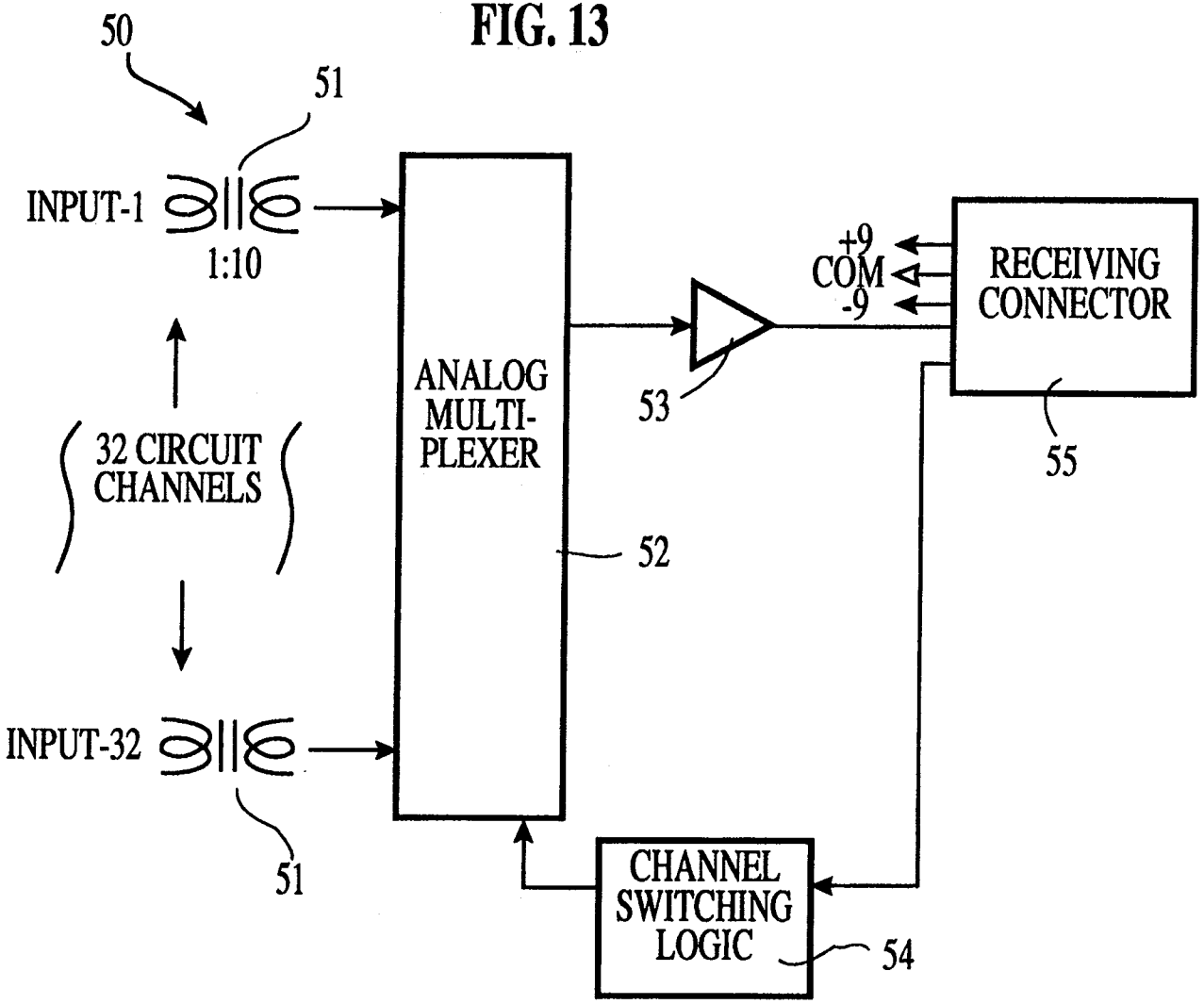
FIG. 13 is a block diagram of a signal receiving circuit in the matrix I/O sending/receiving board included in above-mentioned hardware.

As shown in FIG. 13, the signal receiving circuit 50 is configured of 32 CT (current transformers) 51, an analog multiplexer 52 which is connected to the CT 51, an amplifier 53 and channel switching logic 54 which are connected to the analog multiplexer 52, and a signal receiving connector 55 which is connected to both the amplifier 53 and the channel switching logic 54. The CT 51 are respectively connected through the signal receiving connector 67*b* to the signal receiving lines 26. The signal receiving circuit 50 receives signals through each of the CT 51 from the individual signal receiving lines 26.

Each of the CT 51 isolates the corresponding signal receiving line 26 from the analog multiplexer 52, and amplifies a signal from the signal receiving line 26 by 10 times. The analog multiplexer 52 receives signals through the individual CT 51 sequentially, and the amplifier 53 amplifies a signal from the analog multiplexer 52. The channel switching logic 54 is a component which is similar to the channel switching logic 43 of the signal sending circuit 40.

Figure 14:
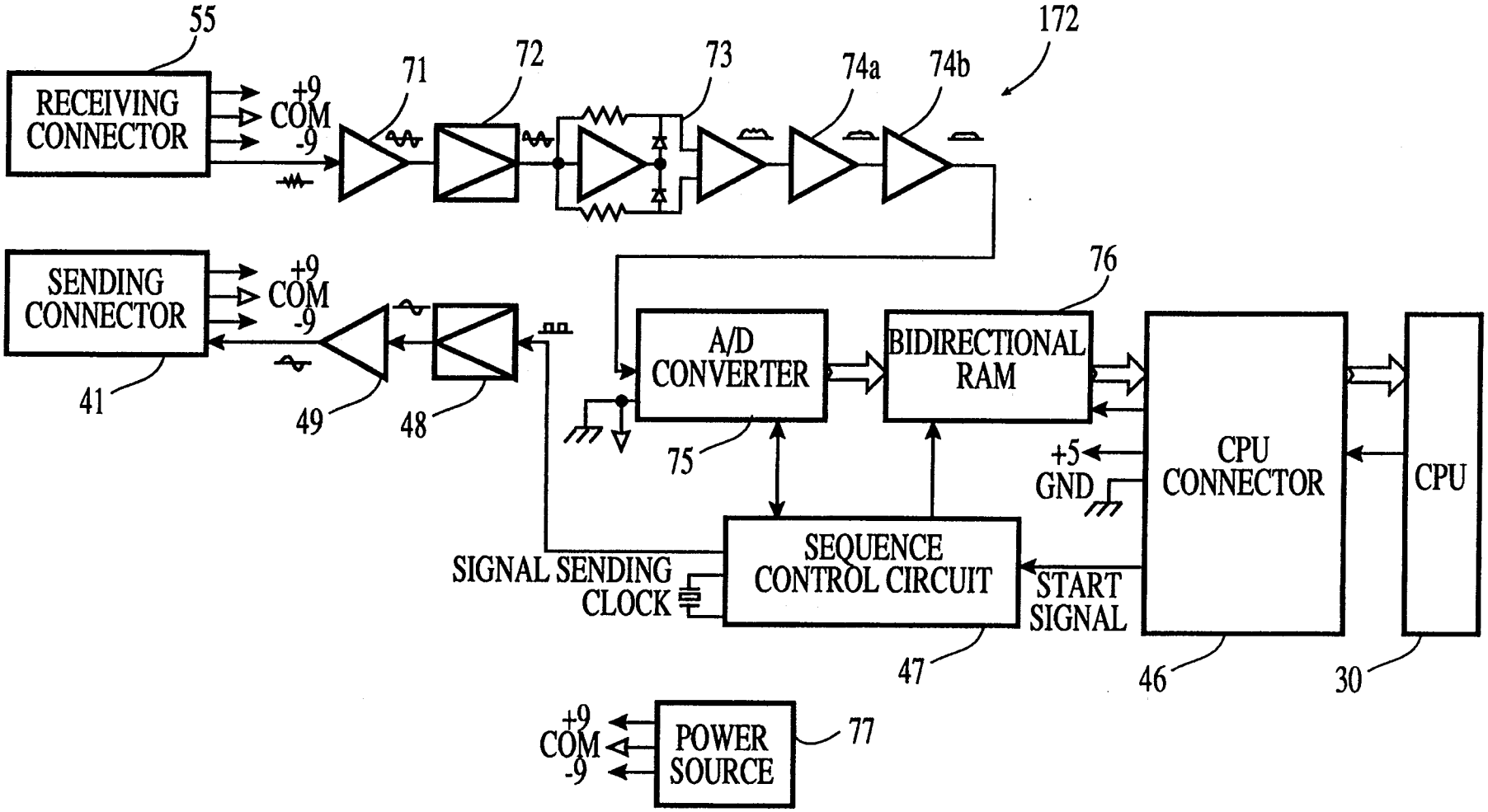
FIG. 14 is a block diagram of signal receiving and signal sending circuits in a CPU memory control board included in above-mentioned/hardware.

As shown in FIG. 14, the CPU memory control board 172 is furnished on the signal sending side thereof with a CPU connector 46 which is connected to a control unit 30, a sequence control circuit 47 which produces signal sending clock pulses in response to a start signal applied through the CPU connector 46 by the control unit, a band-pass filter 48 which accepts the signal sending clock pulses and delivers signals to-be-sent, and an amplifier 49 which amplifies the signals to-be-sent and delivers the amplified signals to the signal sending connector.

In addition, the CPU memory control board 172 is furnished on the signal receiving side thereof with an amplifier 71 which amplifies received signals from the signal receiving connector 55, a band-pass filter 72 which accepts the amplified signals, a full-wave rectifier/amplifier 73 which accepts the received signals from the band-pass filter 72, two stages of low-pass filters 74*a* and 74*b* which accept the received signals from the full-wave rectifier/amplifier 73, an A/D converter 75 which accepts the received signals from the low-pass filter 74*b* and delivers digital data to a bidirectional RAM 76 under the control of the sequence control circuit 47, and the bidirectional RAM 76 which accepts the digital data, writes the received data under the control of the sequence control circuit 47 and delivers the received data to the control unit through the CPU connector 46 in response to a read signal from this CPU connector 46.

The bidirectional RAM 76 is a memory for recording the value of a signal from the signal receiving circuit 50 as detection data at every sensing unit 20*a* configured by the individual signal sending lines 22 and the individual signal receiving lines 26, and includes therein a counter, which executes all the processing of the matrix data of the metal bodies. Further, the CPU memory control board 172 is furnished with a power source unit 77.

The control unit 30 includes an offset means 30*a*, an operation means 30*b*, and comparing means 30*c*, and reads the detected data of the bidirectional RAM 76 and operates them with these means 30*a*, 30*b*, and 30*c*.

The offset means 30*a* updates and memorizes sequentially the value of a signal from the signal receiving circuit 50 as an offset value for each sensing unit by using the detected data of the bidirectional RAM 76 at every scanning. However, at the first detection by the sensing matrix 20, the average value of all the signals from the signal receiving circuit 50 which correspond to every sensing unit 20*a* with no metal object on a panel 11 of a game machine 10 is taken as an initial offset value, which is the offset value peculiar to the game machine 10.

The operation means 30*b* operates the difference between a value of a signal from the signal receiving circuit 50 and the offset value before updating as the absolute value at every sensing unit 20*a* by the detected data.

The comparing means 30*c* compares the set value with the absolute value obtained by the operation means 30*b* at every sensing unit 20*a*. If any sensing unit 20*a* of which the absolute value is larger than the set value is detected, a detection signal for the sensing unit 20*a* associated with the detected data is transmitted by the comparing means 30*c*.

The control unit 30 operates to monitor metal bodies by checking up the detection signals with monitor points memorized in the card 173.

Next, the operation of this embodiment will be described.

Address signals and control signals from the control unit 30 are transmitted to the sensing matrix 20 via the CPU connector 46.

In the sensing matrix 20, on the signal sending side, the sequence control circuit 47 accepts the start signal and divides the frequency of a crystal oscillation clock at a value of 16 [MHz] as is needed, thereby delivering the signal sending clock. The signal sending clock from the sequence control circuit 47 is subjected to waveshaping from the digital signal into the analog signal by the band-pass filter 48. Thereafter, the analog signal is amplified by the amplifier 49 and is delivered to the signal sending connector 41.

Further, the sending signal is amplified by the amplifier 42 in the signal sending circuit 40. The analog multiplexer 44 actuates the totem-pole drivers 45 sequentially in the channels changed-over by the channel switching logic 43. Thus, the totem-pole drivers 45 deliver the signals amplified by the amplifier 42, to the signal sending lines 22 sequentially at predetermined cycles (refer to a step 91 in FIG. 15).

In the sensing matrix 20, a signal of predetermined frequency is sent sequentially to the plurality of signal sending lines 22 which have a folded-back shape from the signal sensing circuit 40, and an alternating magnetic field is generated. An electromotive force is generated by the mutual induction in the signal receiving lines 26 which are electromagnetically coupled with the above-mentioned signal sending lines 22. An eddy current is produced in the surface of the metal body and in the direction of canceling a magnetic flux based on the sensing matrix 20 when the metal body comes near the sensing unit 20*a* on such occasions. Since the magnetic flux changes by the effect of the eddy current, the magnitude of an induced current appearing in the signal receiving line 26 intersecting at the pertinent position changes.

On the signal receiving side, the signal receiving circuit 50 synchronizes with the signal sending circuit 40 by the sequence control circuit 47, and receives signals from the individual signal receiving lines 26 through each of the CT 51. As indicated in FIG. 13, currents being electromagnetic characteristic values which appear on the plurality of signal receiving lines 26 are amplified by 10 times by means of the CT 51. Since the CT sensors 51 are employed for the amplification, the gain of the amplifier on the signal receiving side need not be heightened accordingly. The CT 51 isolate each of the signal receiving lines 26 of the sensing matrix 20 constructing a metal sensor from the analog multiplexer 52 of the signal receiving circuit 50 for preventing the intrusion of the noise from the game machine 10 into the signal receiving circuit 50, and amplifies the received signals.

The analog multiplexer 52 is a circuit in which the signals accepted from the individual signal receiving lines 26 via the CT 51 are changed-over in accordance with the channel switching logic 54 and then delivered sequentially at predetermined cycles. The signals from the analog multiplexer 52 are amplified by 100 times by means of the amplifier 53 (refer to a step 92 in FIG. 15).

Each of the received signals is amplified and detected via the signal receiving connector 55, amplifier 71 and band-pass filter 72. The received signal from the band-pass filter 72 is an analog signal. The analog signal is waveshaped by the full-wave rectifier/amplifier 73. The signal from the full-wave rectifier/amplifier 73 is averaged by integration processing by means of the low-pass filter 74*a*, 74*b*.

Subsequently, the received signal is delivered to the A/D converter 75. The A/D converter 75 converts the signal from the sensing matrix 20 into a digital signal of a predetermined number of bits, for example, a 12-bit unit, and it records the detected data in the bidirectional RAM 76 under the control of the sequence control circuit 76 (refer to a step 93 in FIG. 15). The speed of this processing is as high as 25000 times per second.

Figure 15:
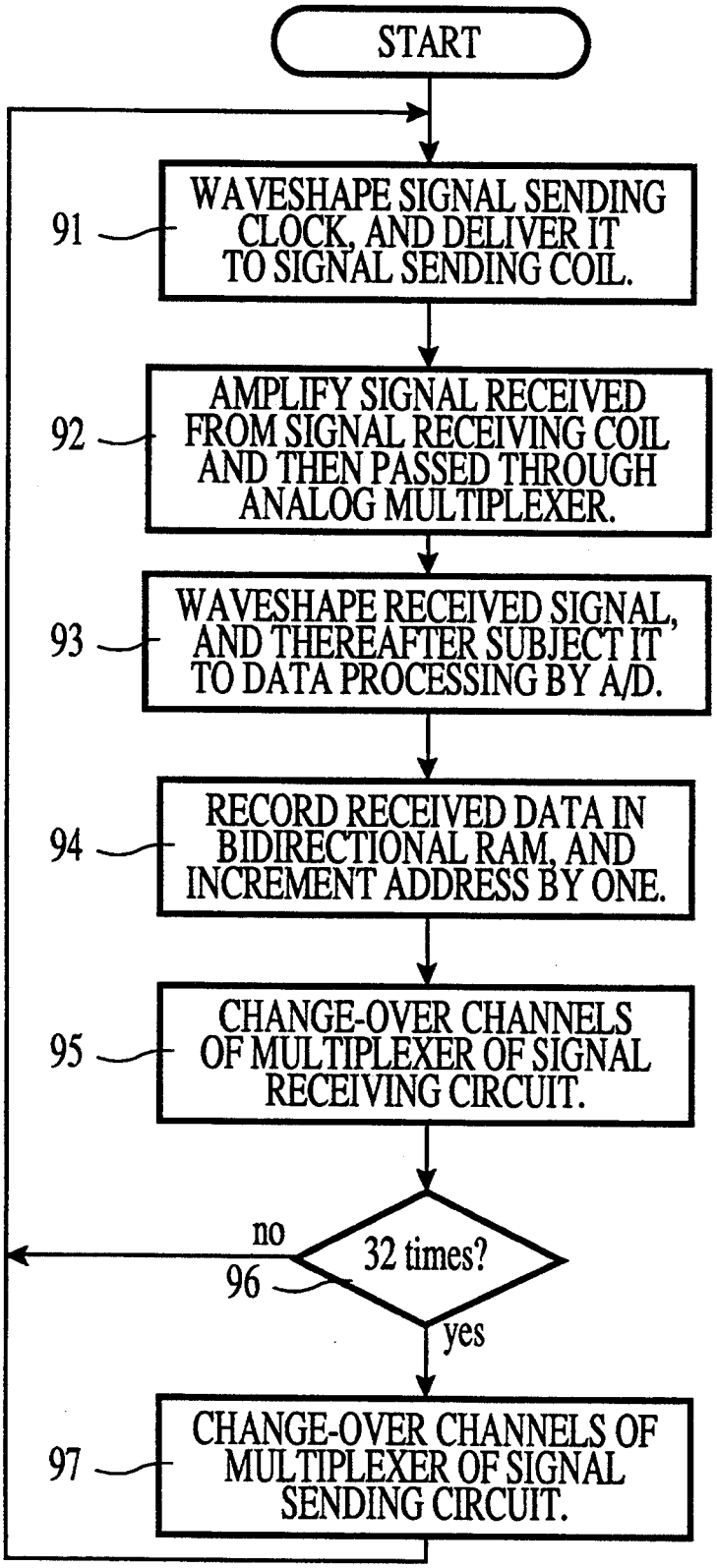
FIG. 15 is a flow chart of the scanning of the sensing matrix in the present embodiment.

After the bidirectional RAM 76 has recorded the detected data irrespective of the operation of the control unit 30 in response to a write signal delivered from the sequence control circuit 63, it increments the address by one upon inputting one clock pulse (refer to a step 94 in FIG. 15). The capacity of the bidirectional RAM 76 is, for example, 2048 bytes.

Next, the analog multiplexer 52 of the signal receiving circuit 50 changes-over the signals from the individual signal receiving lines 26 (refer to a step 95 in FIG. 15) until the above steps are repeated 32 times in correspondence with the 32 signal receiving lines 26 (refer to a step 96 in FIG. 15). After the steps have been repeated 32 times, the analog multiplexer 44 of the signal sending circuit 40 changes-over the signal sending lines 22 (refer to a step 97 in FIG. 15), whereupon the signal processing is repeated again.

Accordingly, the positions of the metal bodies of the sensing matrix 20 can be grasped as the coordinates of the positions where the signal receiving lines 26 in which the received signal has changed intersect with the signal sending lines 22, 22, . . . sent the signal thereto on such occasions which are detected by the scanning operations. The total number of the sensing units 20*a* is 1024 in conformity with the signal sending lines 22 in the 32 rows and the signal receiving lines 26 in the 32 columns. Therefore, no matter which of the safe holes 14*a* and the out hole 15 in the panel 11 the metal body may pass through, it can be detected, The bidirectional RAM 76 memorizes the position of the metal bodies in the sensing matrix 20 as the detected data of the sensing unit 20*a* made with the individual signal sending lines 22 and the individual signal receiving line 26 processed from the intersecting position of the signal receiving line 26 in which the received signal has changed on the basis of the signal from the signal receiving circuit 50 and the signal sending line 22 sent the signal on such occasion.

According to the necessity, the control unit 30 reads the detected data concerning the position of the metal bodies recorded in the bidirectional RAM 76 on the basis of the reading start signal and executes the operation.

Figure 16:
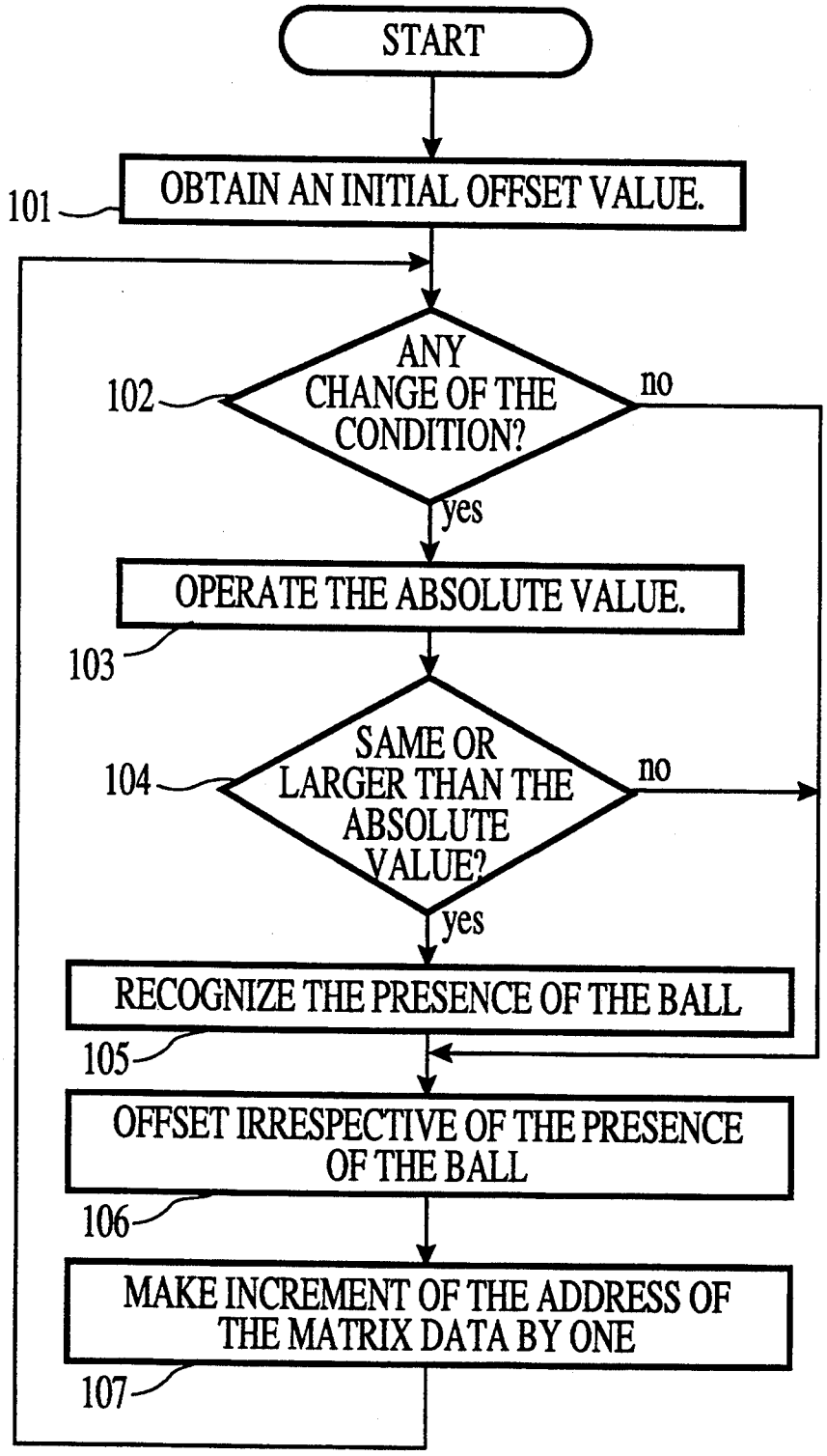
FIG. 16 is a flow chart of the metal body detecting operation in a game machine.

At first, the offset means 30*a* obtains an initial offset value peculiar to the game machine 10 (refer to a step 101 in FIG. 16). On this occasion, as to the detected data of all the 1024 sensing units 20*a* in the condition that there is no metal body on the panel 11, the average value of the value of the signals is obtained by the operation and is set as an initial offset value.

Next, after the game has been started and the metal bodies are on the panel 11, it is judged with respect to the detected data whether the value of the signal has changed or not (refer to a step 102 in FIG. 16), and if the value has changed, the difference between the value of the signal from the signal receiving circuit 50 and the initial offset value which is the offset value before updating is obtained as the absolute value (refer to a step 103 in FIG. 16). The magnitude of the absolute value is compared with that of the set value by the comparing means 30*c* (refer to a step 104 in FIG. 16), thus it becomes possible to detect the presence of a metal body at the sensing unit 20*a* by the result of the comparison whether the magnitude of the absolute value is larger than the set value or not (refer to a step 105 in FIG. 16). As to the set value, the magnitude of it is set large enough to recognize that the magnitude of the absolute value is originated in the metal body.

Whether there is a change of the value of the signal or not, and the magnitude of the absolute value is larger than that of the set value or not, the value of the signal from the signal receiving circuit 50 is updated and memorized in sequence as the offset value at the individual sensing units 20*a* by the offset means 30*a* (refer to a step 106 in FIG. 16). Then, the address of the matrix data in the bidirectional RAM 76 is incriminated by one (refer to a step 107 in FIG. 16), and the control unit repeats above-mentioned process for the next detected data.

If a metal body is detected by the step 105 in FIG. 16, it can be monitored by checking up with the monitor data of the metal body memorized in the card 173 for the detected signal from the comparing means 30*c*.

Since a metal body is detected by the comparison of the magnitude of the set value with that of the absolute value obtained as a difference between the value of the detected data and that of the offset value before updating, only the metal bodies in motion can be detected, and the metal bodies at rest such as the metal bodies caught in the nails (pins) 13, 13 . . . are not detected. In addition, generally in a case of the process of a minute signal such as a signal from the signal receiving circuit 50, the change of the value of the processed signal is caused by the drift of the temperature of the circuit elements or the like, and the magnitude of the value of the processed signal is effected by the property of the circuit element. However, as the detection is effected by obtaining the difference between the value of the signal from the signal receiving circuit and that of the offset value as is stated above, the detection of a metal body is not subject to drift of the temperature.

Thus, the sensing matrix 20 can pursue the motion of metal bodies projected and struck onto the panel 11 of the game machine 10 as the change of the coordinates. In the game machine 10, the progress of the game can be monitored by detecting the moving courses of the metal bodies projected and struck onto the panel on a moving route by means of the sensing matrix 20. It can check an unfair practice, for example, by detecting an abnormal moving course of projected metal bodies. As unfair practices, for example, there is an intentional change of the direction of the movement of metal bodies from the outside of the machine with a magnet or the like. In addition, by counting the metal bodies entered into the safe holes, it is possible to find out a game machine in which the metal bodies abnormally tend to enter into the safe holes. Since it gives bad influence to the management of a game center to leave such machines working, it is necessary to stop such a machine. Therefore, it is important to check whether there is any safe hole that metal bodies are abnormally liable to enter thereinto.

In a case where the situation in which the metal bodies enter the safe holes is to be monitored in the game machine 10 of new type, the card 173 may be exchanged in conformity with the type. Since the card 173 can easily set the monitor data by inserting it to the interface portion 176 of the data processing system, it is easy to alter the monitor data even when it is to be applied to a large number of types of game machines for reasons of replacement of the game machines, or the like. As long as the game machines 10 of the same type are concerned, the cards 173 can be fabricated by copying a single card. Moreover, the card 173 is versatile, so that when more complicated processing is to be executed, it can be coped with by selecting the control unit of the suitable data processing speed at will.

In either case, the rate of the scanning of the metal body is not affected by the CPU because the CPU is not concerned in the scanning.

Regarding the exchange and mounting of the inner glass element 17 provided with the sensing matrix 20, the signal sending connector 67*a* and signal receiving connector 67*b* are detachable, and the inner glass element 17 is readily detached from the signal sending circuit 40 and signal receiving circuit 50 of the mounting frame, so that the sensing matrix 20 having become out of order can be easily exchanged. Also, the sensing matrix 20 can be easily installed on a game machine of the type in which this sensing matrix 20 is not packaged.

Although the offset value is updated at every scanning in this embodiment, it may alternatively be updated at every several scans.

Further, though the absolute value of the difference between the offset value before updating and the newly received signal is emploied in the above-mentioned embodiment, the present invention is not restricted to this. It may also be emploied, for example, a sign of the difference between the offset value before updating and the newly received signal to consider and discriminate whether a metal body is went into or out from the sensing unit.

INDUSTRIAL APPLICABILITY

The present invention is applicable to any of various equipments for detecting the position of a metal body existent in a specified space. By way of example, it is applicable to the detection of the trace of the metal body in a game machine in which this metal body is moved along a panel.

Besides, it is used in an apparatus which selectively detects moving metal bodies in a system wherein moving metal bodies and stationary metal bodies are exist together.

We claim:

1. A sensor for detecting location of a metal body object characterized by comprising:

a magnetic sensing matrix comprised of matrix-arranged sensing units for sensing an object;

a driving means which drives the sensing matrix and receives a signal indicative of the state of each sensing unit; and a detecting means which detects location of the object on the sensing matrix on the basis of the signal received by said driving means; and said detecting means including an offset means which sequentially updates and memorizes a value of said received signal as an offset value at every sensing unit, an operation means which operates a change in values between a value of a newly received signal and the offset value before updating, and a comparing means for comparing the change in values between the two with a preset value to detect the presence of the object.

2. A sensor for detecting location of a metal body as defined in claim 1, characterized in that said operation means is for obtaining an absolute value of said difference between the value of the newly received signal and the offset value before updating as the change in values between the two.

3. A sensor for detecting location of a metal body as defined in claim 2, characterized in that said comparing means is for comparing the obtained absolute value of the difference with the preset value to detect the presence of the object when the absolute value which exceeds the preset value.

4. A sensor for detecting location of a metal body as defined in claim 1, characterized in that said detecting means includes a function to obtain an average value of a signal which indicates a state of each sensing unit without an object and set the average value as an initial offset value for the offset means at the time of the initialization.

5. A sensor for detecting location of a metal body object characterized by comprising:

a sensing matrix comprised of matrix-arranged sensing units for sensing an object;

a driving means which drives the sensing matrix and receives a signal indicative of the state of each sensing unit; and a detecting means which detects location of the object on the sensing matrix on the basis of the signal received by said driving means; and said detecting means including an offset means which sequentially updates and memorizes a value of said received signal as an offset value at every sensing unit, an operation means which operates a chance in values between a value of a newly received signal and the offset value before updating, and a comparing means for comparing the change in values between the two with a preset value to detect the presence of the object, characterized in that said sensing matrix has a plurality of signal sending lines which have a folded-back shape including outward paths and return paths arranged coplanarly to generate a magnetic field when energized, and a plurality of signal receiving lines which have a folded-back shape including outward paths and return paths arranged coplanarly so as to be electromagnetically coupled with said signal sending lines to detect a change of a magnetic flux caused by the approach of the metal object; said signal sending line and said signal receiving line being arranged with their planes in parallel and in directions intersecting each other, and said sensing unit being set up within a place defined by the outward path and return path of the signal sending line and the outward path and return path of the signal receiving line intersecting with those of the signal sending line.

6. A sensor for detecting location of a metal body as defined in claim 5, characterized in that said driving means includes a signal sending circuit which sends alternating current signals sequentially to the individual signal sending lines; and a signal receiving circuit which receives the signals from the individual signal sending lines sequentially in synchronism with said signal sending circuit.

* * * * *